US007177565B1

(12) United States Patent
Miller

(10) Patent No.: US 7,177,565 B1
(45) Date of Patent: Feb. 13, 2007

(54) SEALING STRUCTURE FOR A TONER CARTRIDGE

(75) Inventor: Steven Miller, Mobile, AL (US)

(73) Assignee: Cartridge Corporation of America, Inc., Clearwater, FL (US)

( * ) Notice: Subject to any disclaimer, the term of this patent is extended or adjusted under 35 U.S.C. 154(b) by 149 days.

(21) Appl. No.: 11/120,493

(22) Filed: May 3, 2005

Related U.S. Application Data

(63) Continuation-in-part of application No. 10/907,470, filed on Apr. 1, 2005, which is a continuation of application No. 10/742,323, filed on Dec. 19, 2003, now Pat. No. 7,136,608.

(51) Int. Cl.
*G03G 15/08* (2006.01)
*G03G 15/04* (2006.01)

(52) U.S. Cl. ..... 399/103; 399/105; 399/119; 399/120

(58) Field of Classification Search ..... 399/103, 399/105, 120, 119, 111, 113, 262
See application file for complete search history.

(56) References Cited

U.S. PATENT DOCUMENTS 5,485,249 A * 1/1996 Higeta et al. ..... 399/105
6,714,749 B2 * 3/2004 Sato et al. ..... 399/102
6,980,753 B2 * 12/2005 Yoshiki ..... 399/103

* cited by examiner

*Primary Examiner*—Hoang Ngo
(74) *Attorney, Agent, or Firm*—Thomas E. Toner; Smith & Hopen, P.A.

(57) ABSTRACT

A toner cartridge includes improved sealing mechanisms to prevent the escape of toner from the cartridge. Soft and rigid seals are used to seal the distal ends of the developer roller and doctor bar.

15 Claims, 13 Drawing Sheets

SEALING STRUCTURE FOR A TONER CARTRIDGE

CROSS REFERENCE TO RELATED APPLICATIONS

This application is a continuation-in-part to co-pending U.S. patent application Ser. No. 10/907,470 entitled: "Integrated Toner Cartridge with Toner Agitator and Sensing Device," filed Apr. 1, 2005, which is a continuation of U.S. patent application Ser. No. 10/742,323 entitled: "Removable Toner Cartridge Universal Adapter," filed Dec. 19, 2003 now U.S. Pat. No. 7,136,608.

BACKGROUND OF THE INVENTION

Laser printers use a coherent beam of light, hence the term "laser printer," to expose discrete portions of an image transfer drum thus attracting the printing toner. Toner is a mixture of pigment (most commonly black) and plastic particles. The toner becomes electro-statically attracted to exposed portions of the image transfer drum. The toner is transferred to paper, or other medium, as it passes over the rotating image transfer drum. Subsequently, the paper is heated so that the plastic is melted thereby permanently affixing the ink to the paper.

The vast majority of commercially available desktop laser printers include replaceable or removable toner cartridges that incorporate an image transfer drum, a toner tank, and a metering system. A drive mechanism is connected to the drum and metering system. Modern toner cartridges often include a variety of sensors that interact with the laser printer to indicate the status of the cartridge. Indications relating to toner level, print quality and general cartridge function are often included as well. A large number of types and sizes of toner cartridges are currently available. The sensing system typically includes an encoder wheel interconnected with a rotating agitating paddle within a cylindrical toner tank. Movement of the agitating paddle feeds toner into the metering system. The encoder wheel reports the movement of the agitating paddle wheel through the toner reservoir.

The toner cartridges of the prior art employ sealing mechanisms which leave gaps at the lateral edges of the doctor bar and developer roller through which toner can escape. Therefore, what is needed is a sealing mechanism which seals the developer roller and doctor bar on all sides, preventing the escape of toner.

SUMMARY OF INVENTION

The long-standing but heretofore unfulfilled need for a toner cartridge that is adapted to be of an simplified construction, thereby limiting the number of elements required during manufacture, and which also includes improvements that overcome the limitations of prior art toner cartridges is now met by a new, useful, and non-obvious invention.

In one embodiment the toner cartridge comprises a ramp area depending from the body of said toner cartridge, a developer roller having a cylindrical surface in overlying relation to said ramp area, at least one arcuate recess adjacent to said ramp area to accommodate said developer roller therein, a first elevated surface integral with said arcuate recesses having a modulus of elasticity greater than that of said developer roller disposed to engage in conforming contact with said developer roller, and a second sealing surface disposed across said ramp area to mate with said cylindrical surface of said developer roller forming a fluid-tight barrier therebetween.

Said first sealing surface has a modulus of elasticity greater than that of said developer roller. Since the sealing surface is harder than the developer roller, the developer roller is deformed at the point of contact and thereby forms a seal with the raised sealing surface.

The novel toner cartridge is equipped with elevated regions at the distal ends of said ramp area disposed to elevate the distal ends of said second sealing surface. The raised edges are chamfered to provide a transition area between the second sealing surface and the sides of the ramp area and toner cartridge.

A flattened area is disposed adjacent to said raised chamfered edges such that a pocket is formed when the toner cartridge is assembled. A non-hardenable sealant is placed within said pocket thereby forming a seal between the lower side of the second sealing surface and the toner cartridge. The distal edges of the second sealing surface are chamfered to accommodate said chamfered edges of said ramp area.

The novel toner cartridge also comprises a doctor bar. Gaskets are disposed at the distal ends of said doctor bar whereby said gaskets sealingly engage at least one inner surface of said toner cartridge.

In another embodiment, soft seals are used to seal the distal ends of the developer roller. In this embodiment at least one lateral sealing interface is integrally disposed within, and conforming to, said arcuate recess and has a raised ridge disposed along the inner circumference thereof in conforming engagement with said developer roller. The soft sealing interface engages the surface of said developer roller. An upper sealing surface is integrated with said lateral sealing interface disposed to seal the lateral ends of said doctor bar.

The soft lateral seals are adapted with raised chamfered edges adjacent the distal ends of said ramp area and have a flattened area adjacent to said chamfered edges such that a pocket is formed when the toner cartridge is assembled. A non-hardenable sealant is disposed within said pocket. The soft sealing interface further comprises elevated surfaces having a modulus of elasticity less than that of said developer roller disposed to engage in conforming contact with said developer roller.

In yet another embodiment, the novel toner cartridge comprises at least one lateral sealing interface having a leading edge conforming to, and extending to a point past, said arcuate recess whereby said sealing interface engages the cylindrical surface of said developer roller and the surface of said doctor bar. The sealing surface is constructed from a rigid material such as metal and therefore has a modulus of elasticity greater than that of said developer roller. An upper sealing surface is integrated with said lateral sealing interface disposed to seal the lateral ends of said doctor bar.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel toner cartridge has a photoconductive drum on which an electrostatic image is formed. The photoconductive drum rotates in a plane perpendicular to that of the print medium passing through the toner cartridge. A recovery blade is placed in direct contact with the photoconductive drum. During the imaging stage, the photoconductive drum is exposed to light, usually a laser, which imprints a latent image thereon. A developing roller converts the electrostatic-image into a toner-image. Toner is then transferred to the print medium by means of static electricity, an opposite polar charge on the print medium, established by a transfer roller. The recovery blade then scrapes the waste toner from the photoconductive drum and directs it to the waste bin.

Rigid Sealing Structure

Figure 1A:
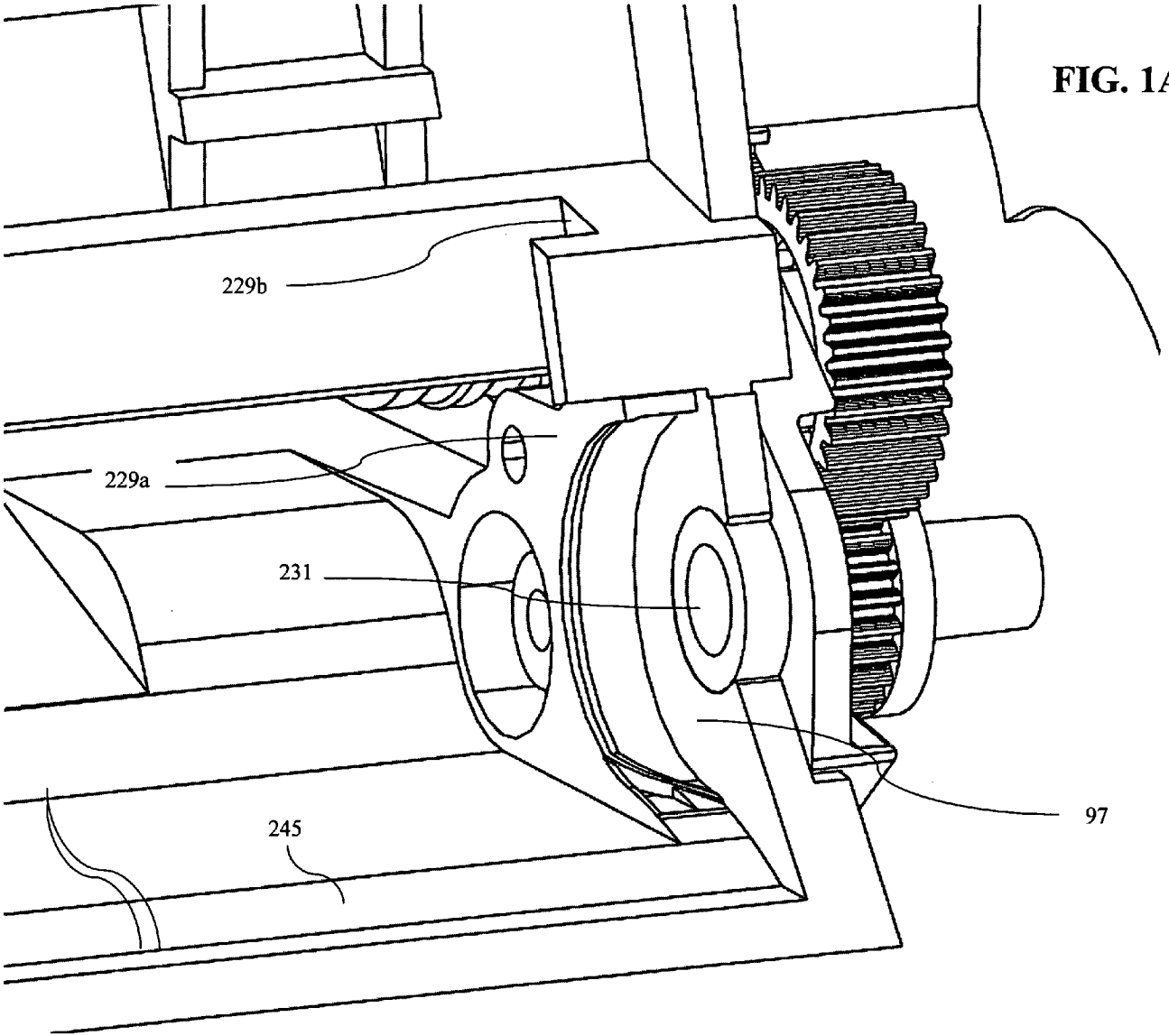
FIG. 1A is a perspective view of the ramp area and arcuate recess of the novel toner cartridge.

FIG. 1A is a perspective view of an embodiment of the present invention and is particularly well adapted for use in new-manufacture toner cartridges but is also applicable for retrofitting of existing devices. In a general embodiment the present invention mounts a sealing blade to the ramp area of the toner cartridge. In this manner, toner leakage along the length of the developer roller 296 is avoided.

Figure 1B:
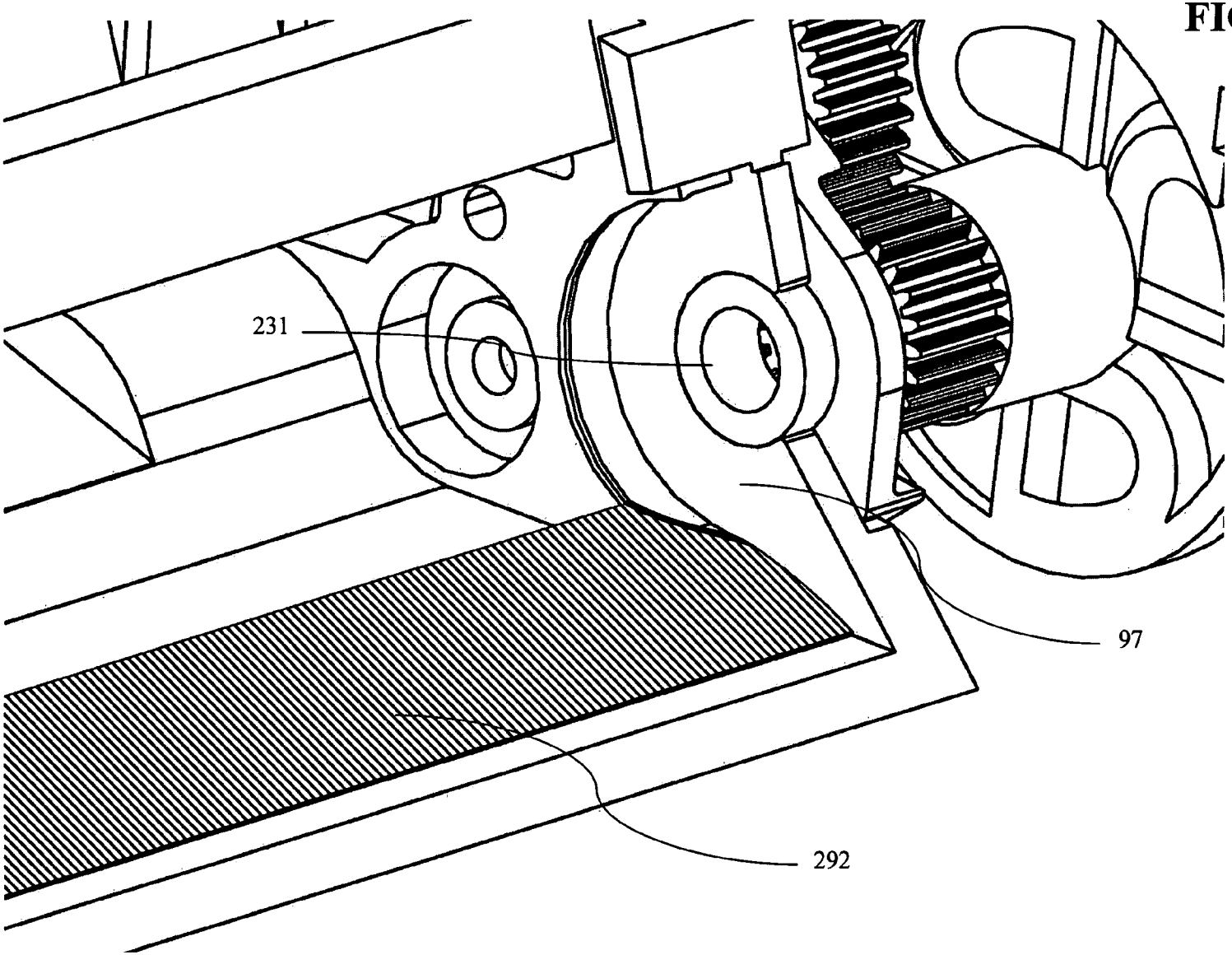
FIG. 1B is a perspective view of the ramp area with the sealing blade in place and arcuate recess of the novel toner cartridge.

The developer roller (not shown) is accepted by aperture 231 disposed within inner wall 97 of the toner cartridge. FIG. 1B shows that sealing blade 292 adheres to ramp area 245 thus forming a seal between ramp area 245 and the developer roller.

Figure 1C:
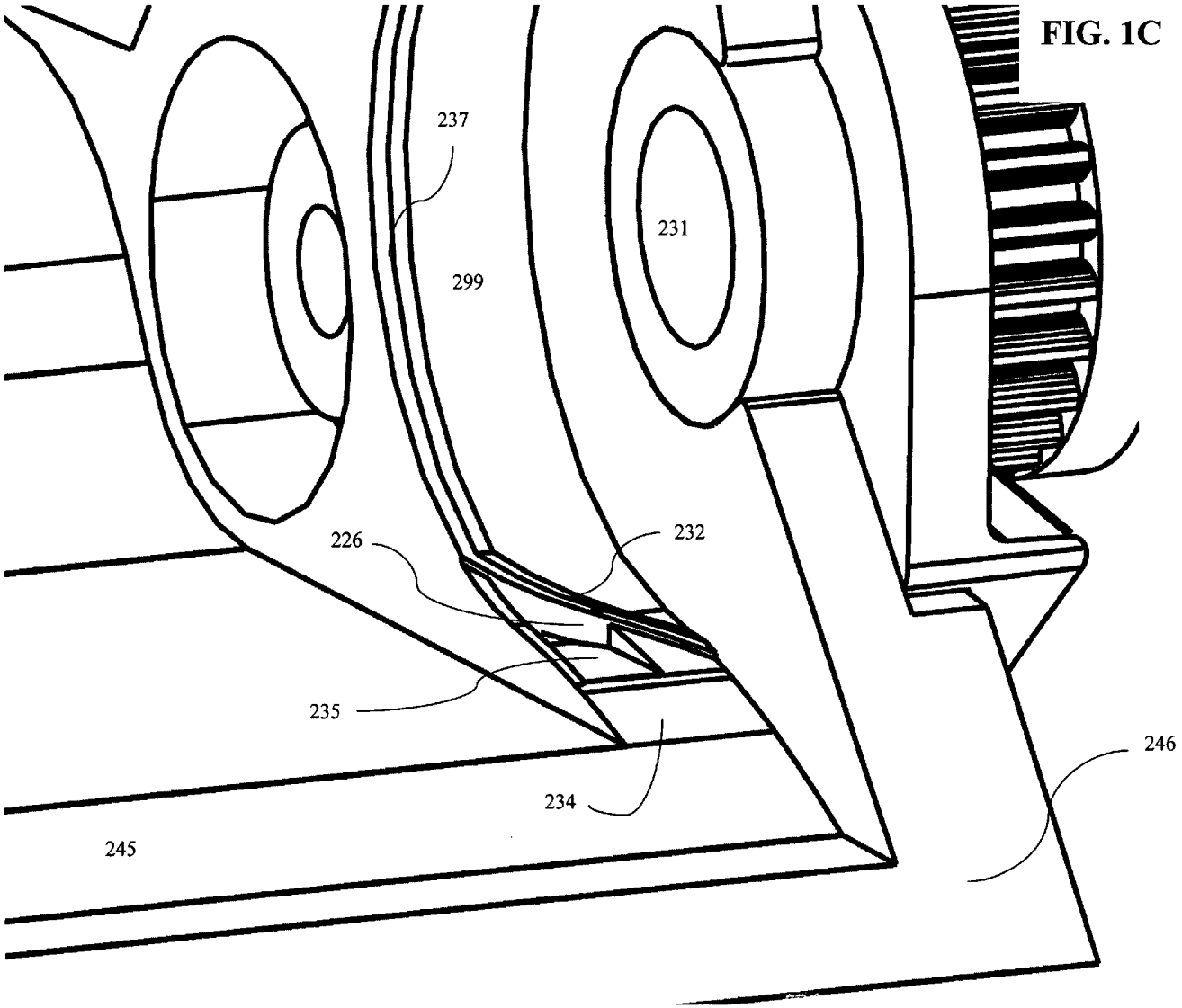
FIG. 1C is a perspective view of the novel sealing structure of the instant invention showing the pocket area which receives the non-hardenable sealant.
Figure 2:
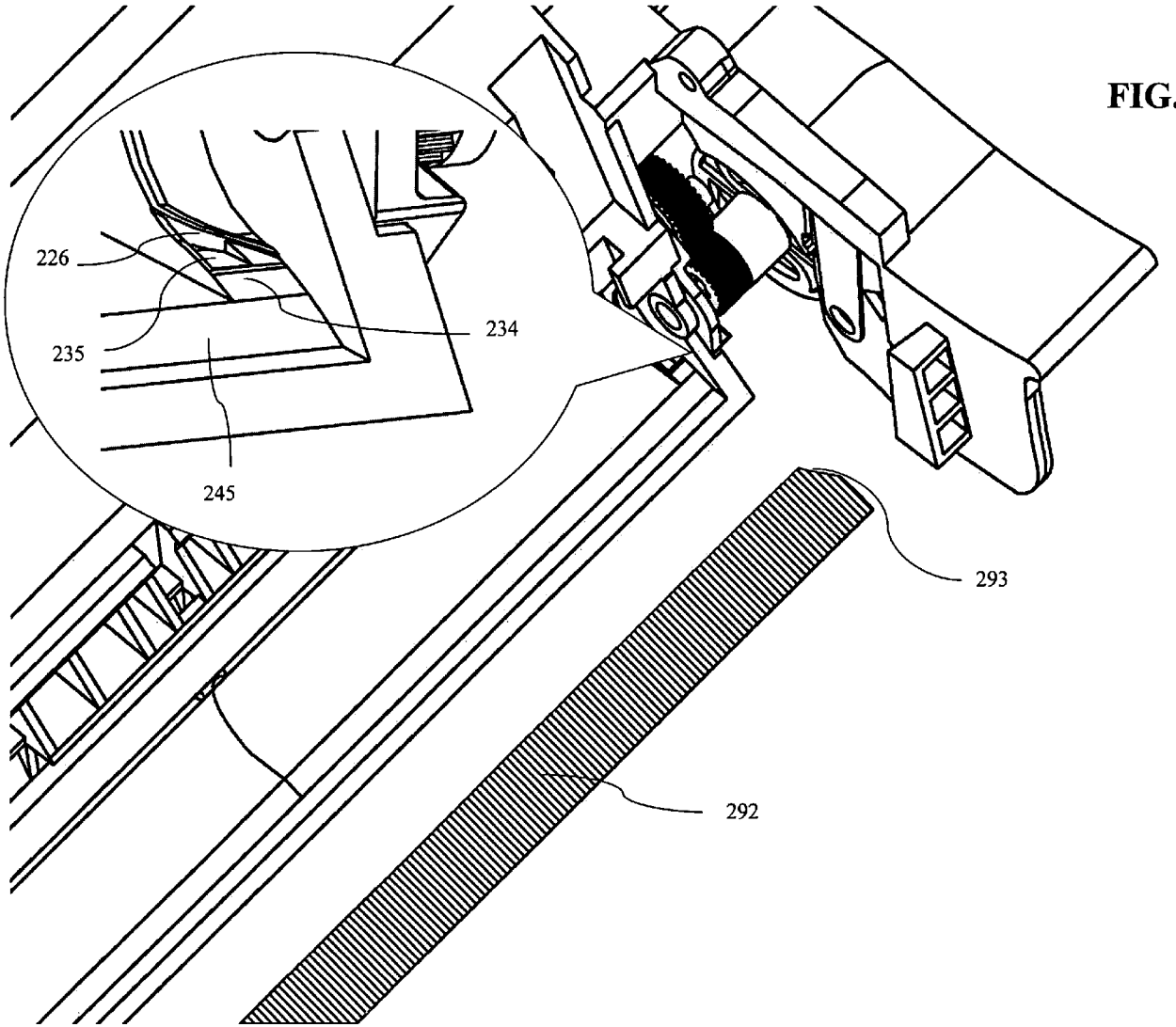
FIG. 2 is an alternate perspective view of the novel sealing structure of the instant invention showing the pocket area which receives the non-hardenable sealant.

The outer edges of ramp area 245 are met by ramp supports 234. Ramp supports 234 terminate at their upper ends in raised walls 226 which form pockets 235. A non-hardening sealant can be added to pockets 235 to prevent toner from leaking under sealing blade 292. In a preferred embodiment ramp supports 234 and raised walls 226, which form pockets 235, are formed integrally with the body of the toner cartridge (FIG. 1C). To accommodate ramp supports 234 and raised walls 226, which form pockets 235, sealing blade 292 is chamfered at its outer edges 293 (FIG. 2).

The developer roller 296, having a deformable surface constructed from rubber, urethane, or any other pliable material mates with rigid raised walls 237. Angled rigid sealing ribs 232 (FIG. 1C) provide an additional sealing surface against the outer ends of the developer roller 296. Raised walls 237 and angled rigid sealing ribs 232 are sufficiently rigid to cause a slight deformation in the surface of the developer roller 296 where it makes contact. It is the conforming contact between these rigid members and the relatively pliable surface of the developer roller 296 which forms the seal. The developer roller has a modulus of elasticity (measured in $Kn/mm^2$) less than that of the raised sealing surfaces, thereby restricting deformation to the developer roller as it engages and rotates across said raised sealing surface. The developer roller rotates along its longitudinal axis making sealing contact with sealing blade 292 along the length of its surface. In this manner a tight seal is formed which prevents toner from leaking from the cartridge.

Lower contact surface 246 is equipped with a thin sealing blade, similar to sealing blade 292, which acts as a drip layer for toner which may seep between the developer roller 296 and sealing blade 292.

Figure 3:
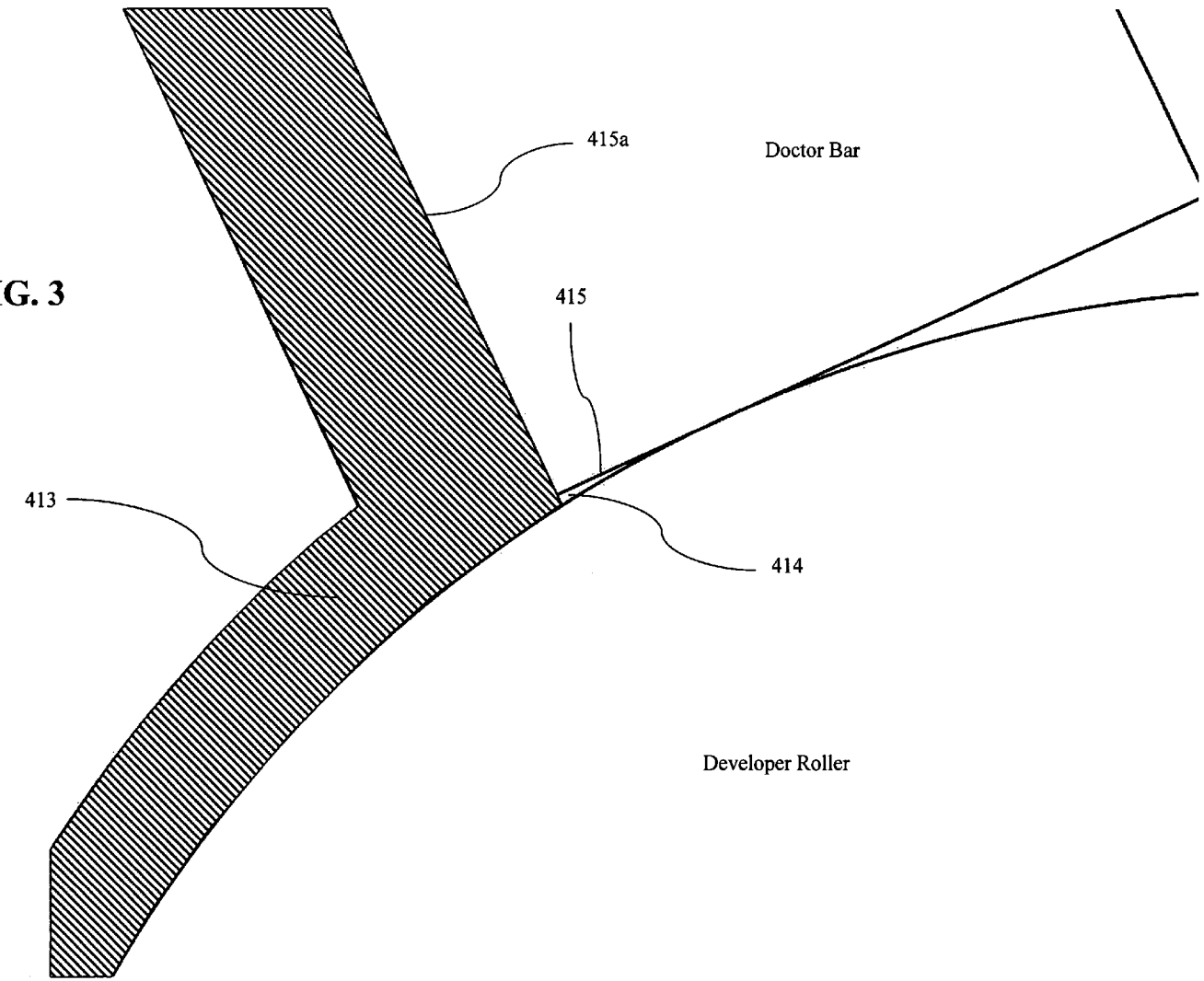
FIG. 3 is a perspective view of the sealing apparatus of the prior art.

This configuration avoids the failure of the prior art wherein the outer ends of the developer roller 296 are sealed in a one piece seal arrangement 413 (FIG. 3) that seals the inner surface 415*a* of the doctor bar 214 and the outer surface of the developer roller 296. The configuration of the prior art results in a gap 414 between lower surface 415 of doctor bar 214 and the outer surface of the developer roller.

Figure 4:
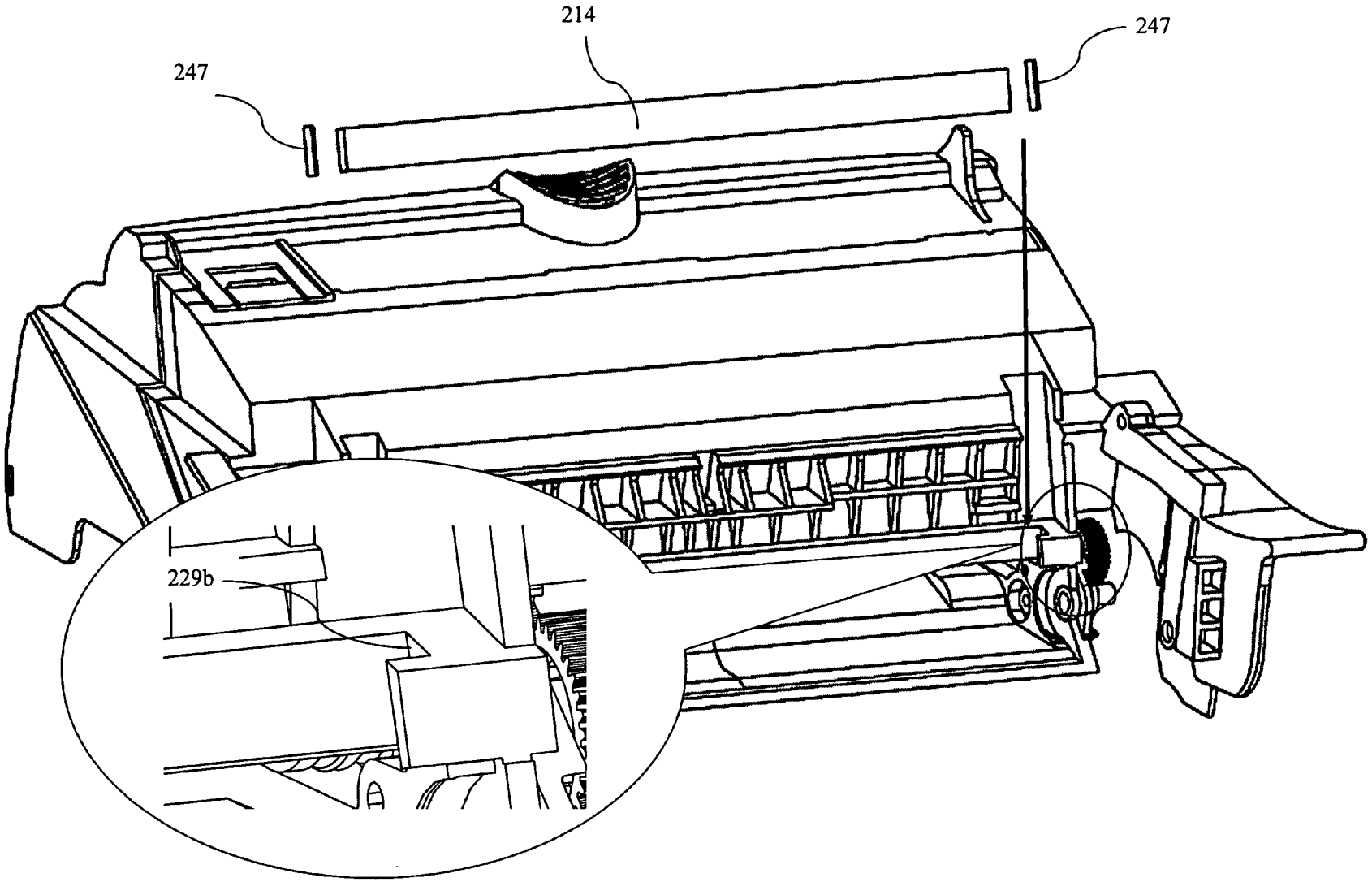
FIG. 4 is a perspective view of the sealing gaskets and sealing surface of the instant invention.

To overcome this failure of the prior art, doctor bar 214 is equipped with end gaskets 247 (FIG. 4) which engage the inner surfaces 229*a* and 229*b* of the toner cartridge. Since gaskets 247 are able to conform to the shape of meeting surfaces 229*a*, 229*b* as well as that of the developer roller 296, a watertight seal is formed which prevents the escape of toner from the cartridge.

Soft Developer Roller/Doctor Bar Seal

Figure 5:
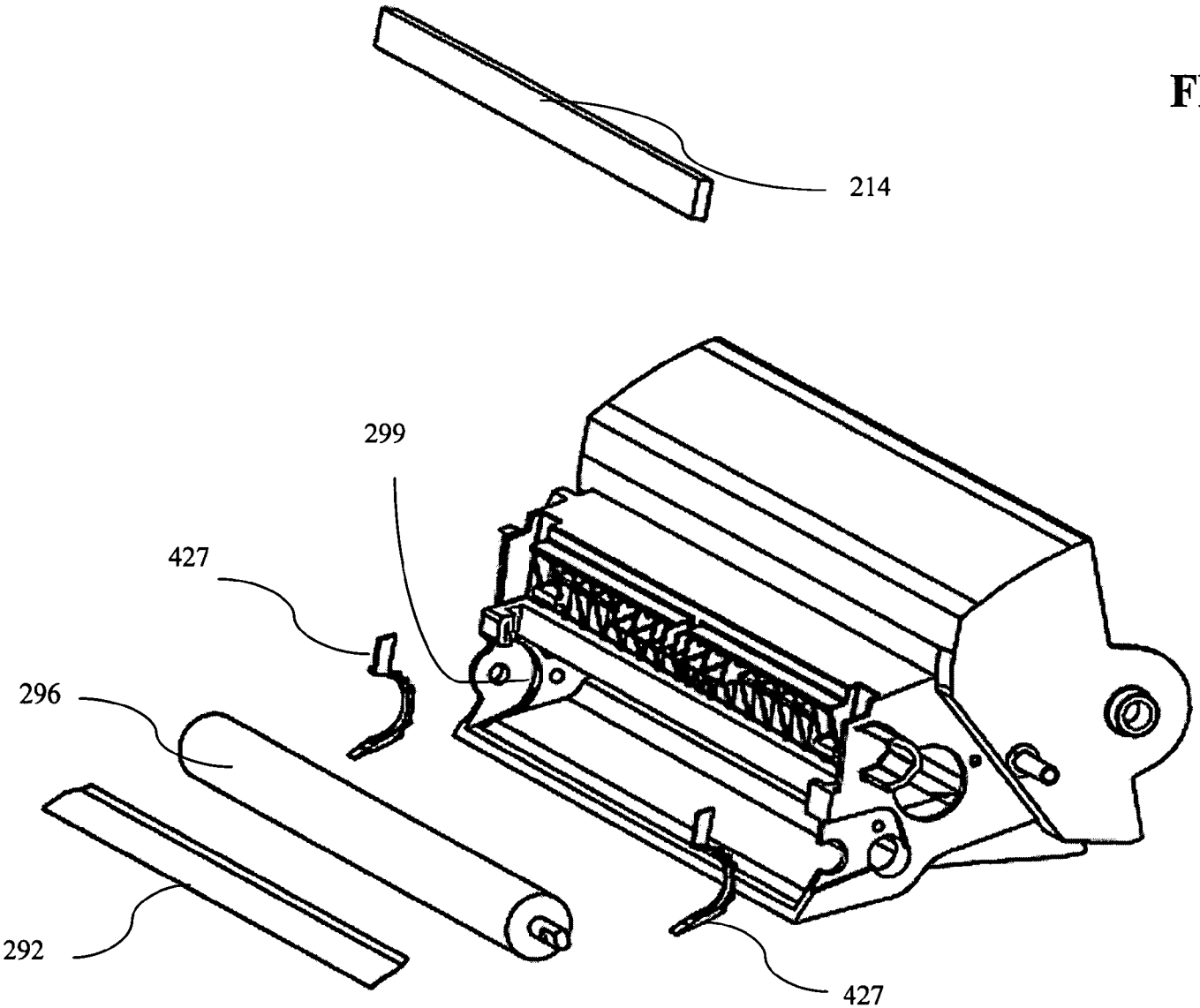
FIG. 5 is an exploded view of an embodiment of the instant invention employing soft lateral seals.

As discussed supra, sealing blade 292 adheres to ramp area 245. In an alternate embodiment, the end seal members 427 (FIG. 5) are installed on arcuate recess 299 of the toner cartridge. In this embodiment, the chamfered outer edges 293 of sealing blade 292 are supported by soft-seal ramp supports 419 and support areas 420.

Figure 6B:
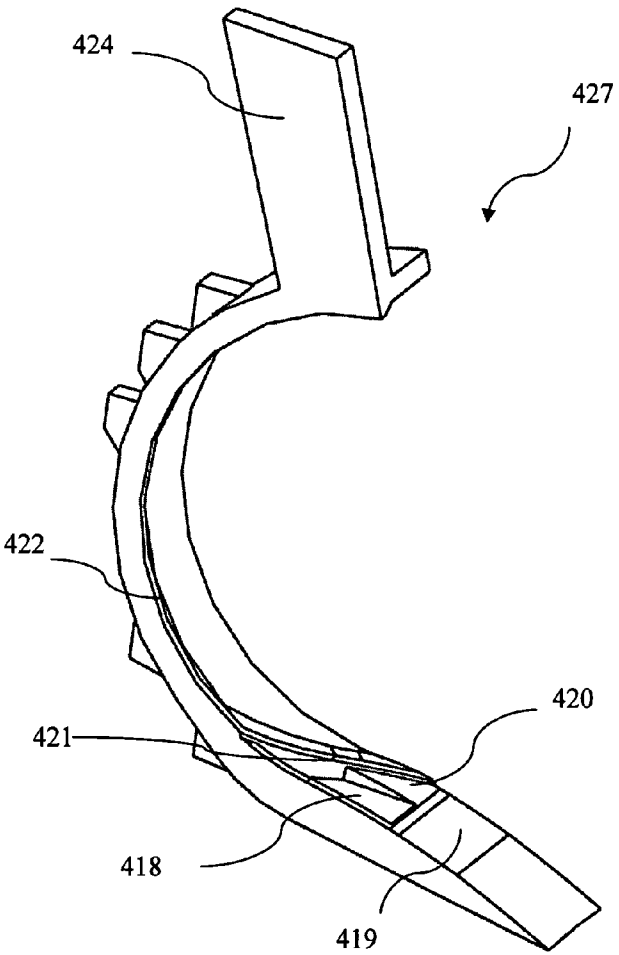
FIGS. 6A and 6B show alternate perspective views of the soft seals of the instant invention.
Figure 6A:
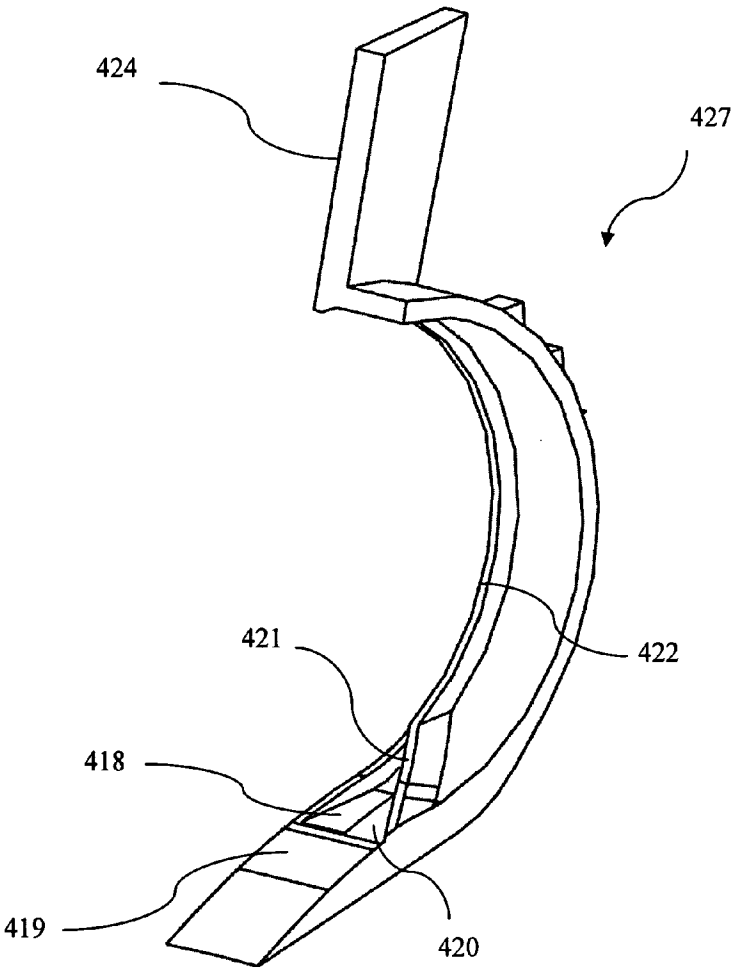

As with the previous embodiment, pockets 418 are formed along the bottom edge of seals 427 adjacent to support areas 420 (FIGS. 6A and 6B). A non-hardenable sealant is received within pockets 418 to ensure that toner does not escape under sealing blade 292.

Chamfered edges 293 of sealing blade 292 mate flush with angled sealing surfaces 421 (FIGS. 6A and 6B). Angled sealing surface 421 is elevated above pocket 418 and support surface 420 thereby forming a step with an edge.

Figure 7:
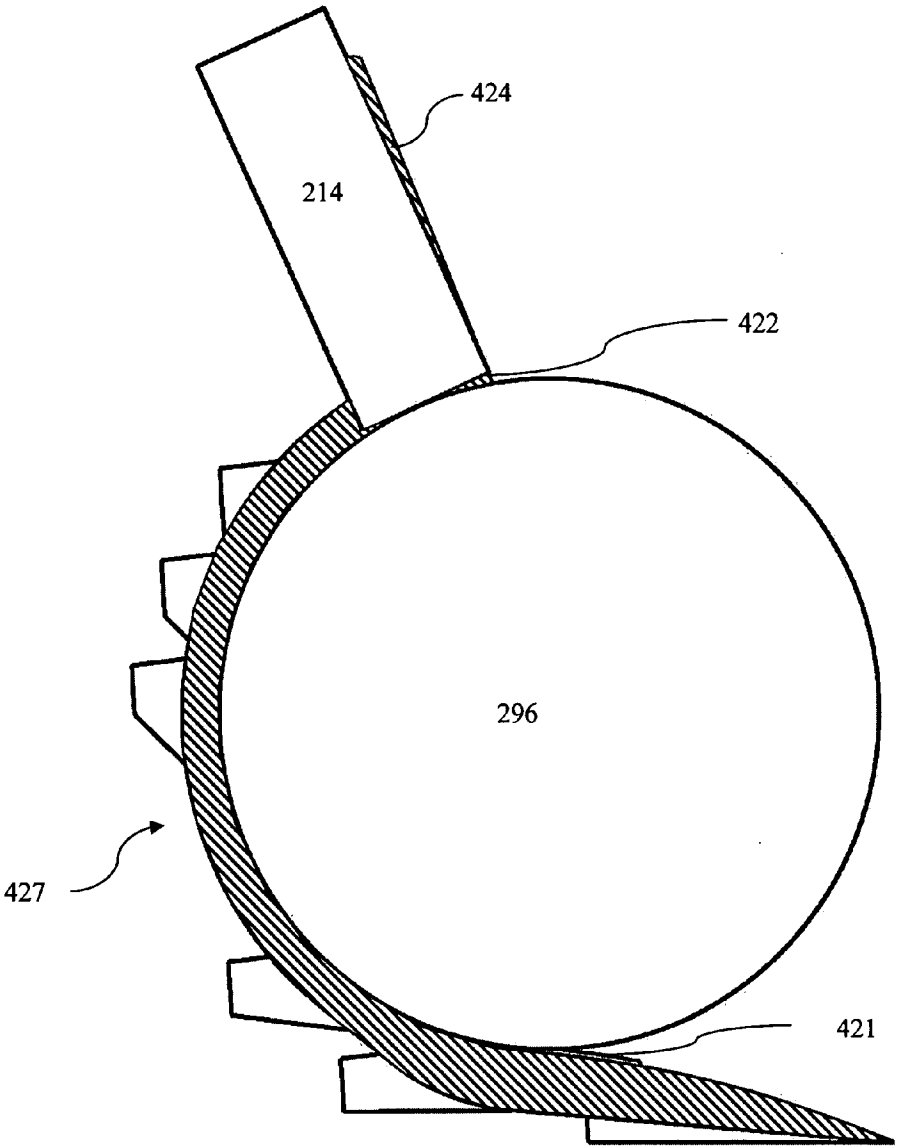
FIG. 7 is a perspective view showing the complete seal formed by the soft seal of the instant invention.

The developer roller 296, constructed from rubber, urethane, or any other pliable material mates with raised lips 422 and angled sealing surface 421 of soft developer roller seals 427. Soft developer roller seals 427 are constructed of an elastomeric material, such as rubber. With soft seals 427 in place along the distal ends of the developer roller 296 and doctor bar 214, and with sealing blade 292 in place in underlying relation thereto, toner is prevented from escaping the cartridge (FIG. 7).

As with the previous embodiment, lower contact surface 246 is equipped with a thin sealing blade, similar to sealing blade 292, which acts as a drip layer for toner which may seep between the developer roller 296 and sealing blade 292.

Figure 8:
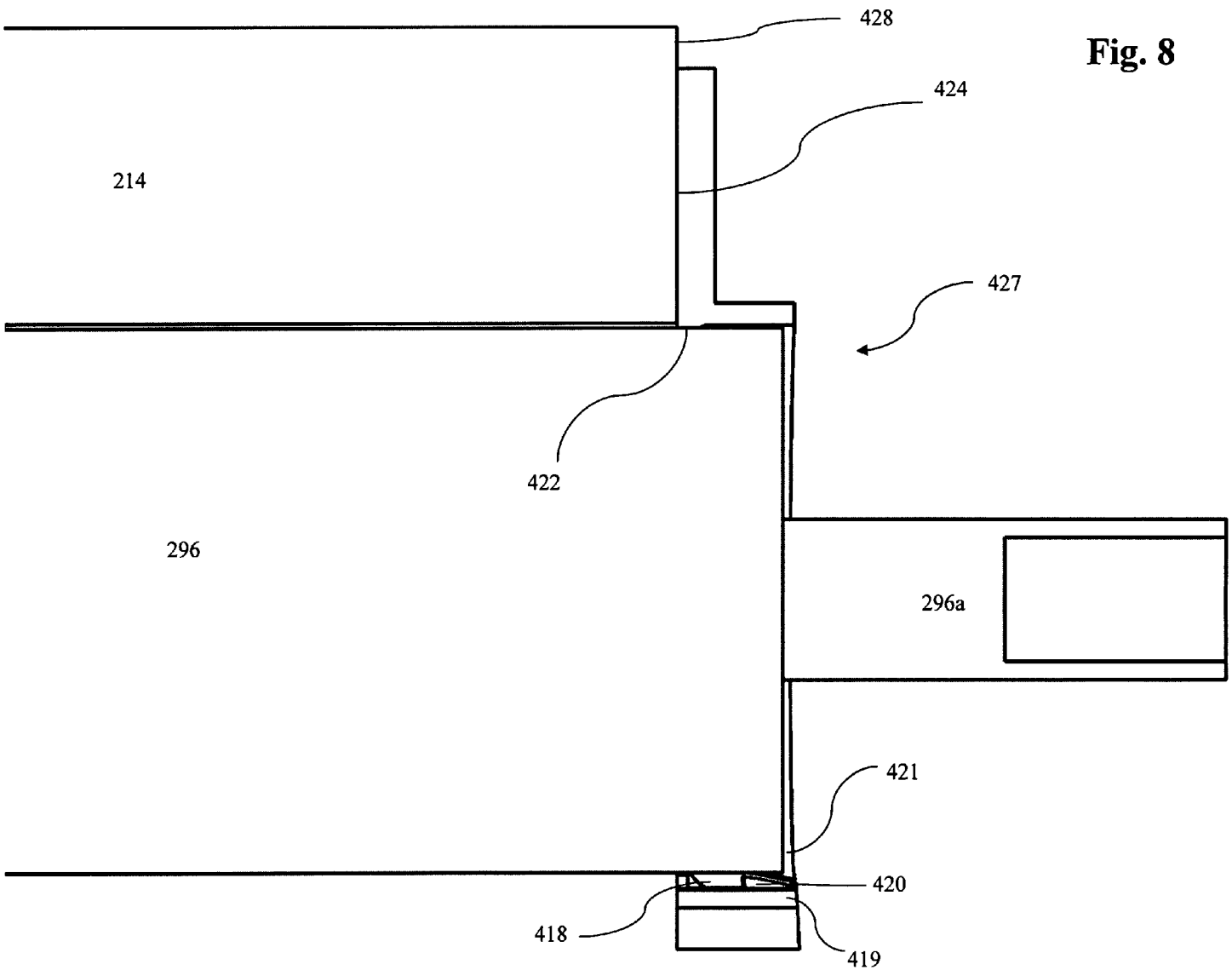
FIG. 8 is an alternate perspective view showing the complete seal formed by the soft seal of the instant invention.

With the distal ends and lower surface of the developer roller 296 sealed, doctor bar 214 is installed to form the final sealing surface (FIG. 8). Distal ends 428 of doctor bar 214 seal in flushing engagement with upper sealing surfaces 424 of the soft developer roller seals 427. The bottom surface of doctor bar 214 engages the relatively deformable surface of the developer roller 296 thereby forming a seal.

As shown in FIG. 8, raised lips 422 of soft developer roller seals 427 completely seal the distal ends of the developer roller 296 with only the shaft 296*a* of developer roller 296 extending therethrough. Similarly, sealing surfaces 424 completely seal the distal ends of doctor bar 214. Doctor bar 214 and sealing blade 292 seal the developer roller 296 along the length of it surface on its upper and lower edges. Given the developer roller 296 is now sealed on all sides, toner cannot escape the cartridge.

Rigid End Seals

Figure 9A:
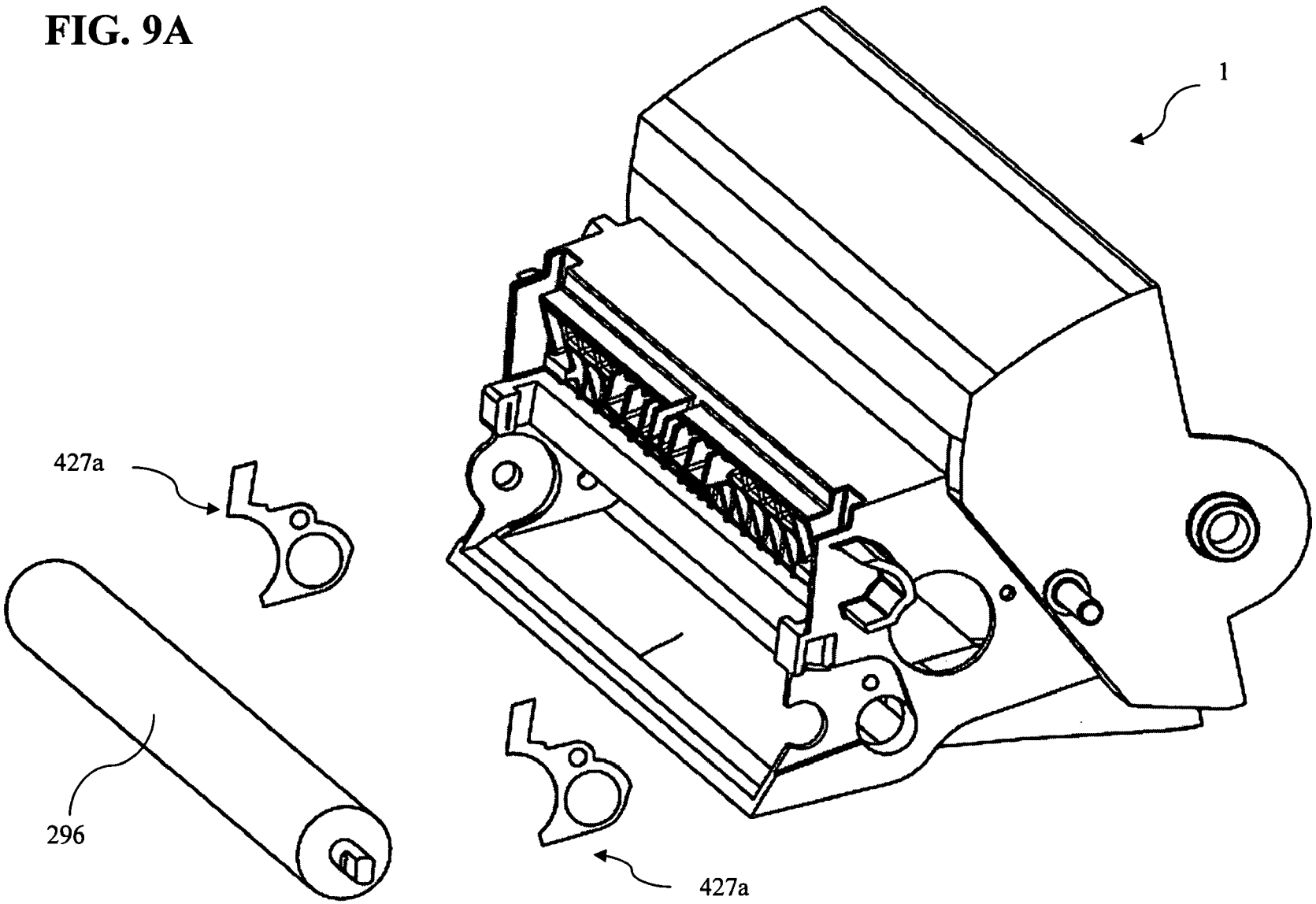
FIGS. 9A–9C are perspective views of the thin rigid sealing structure of the novel toner cartridge.
Figure 9B:
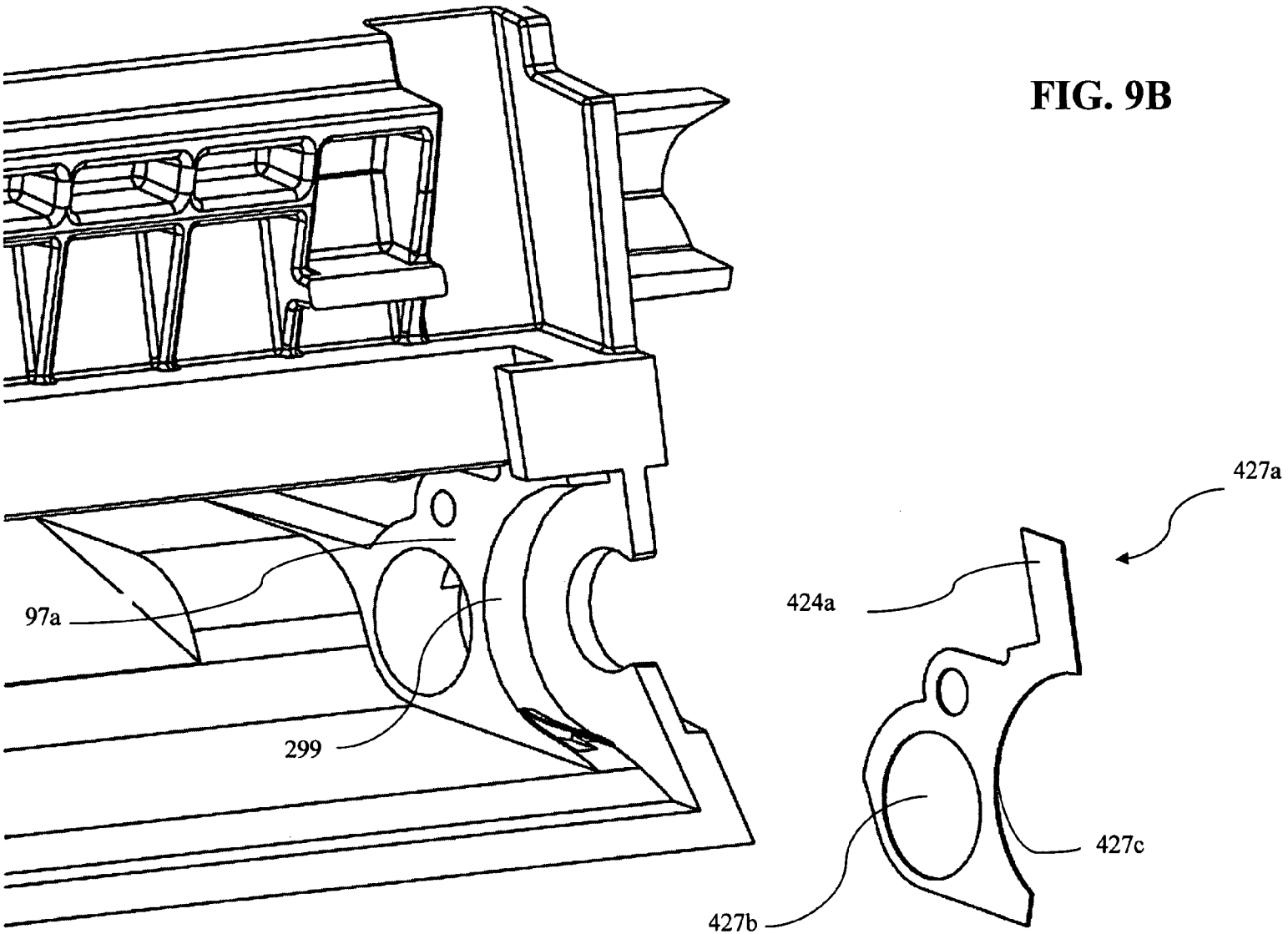
Figure 9C:
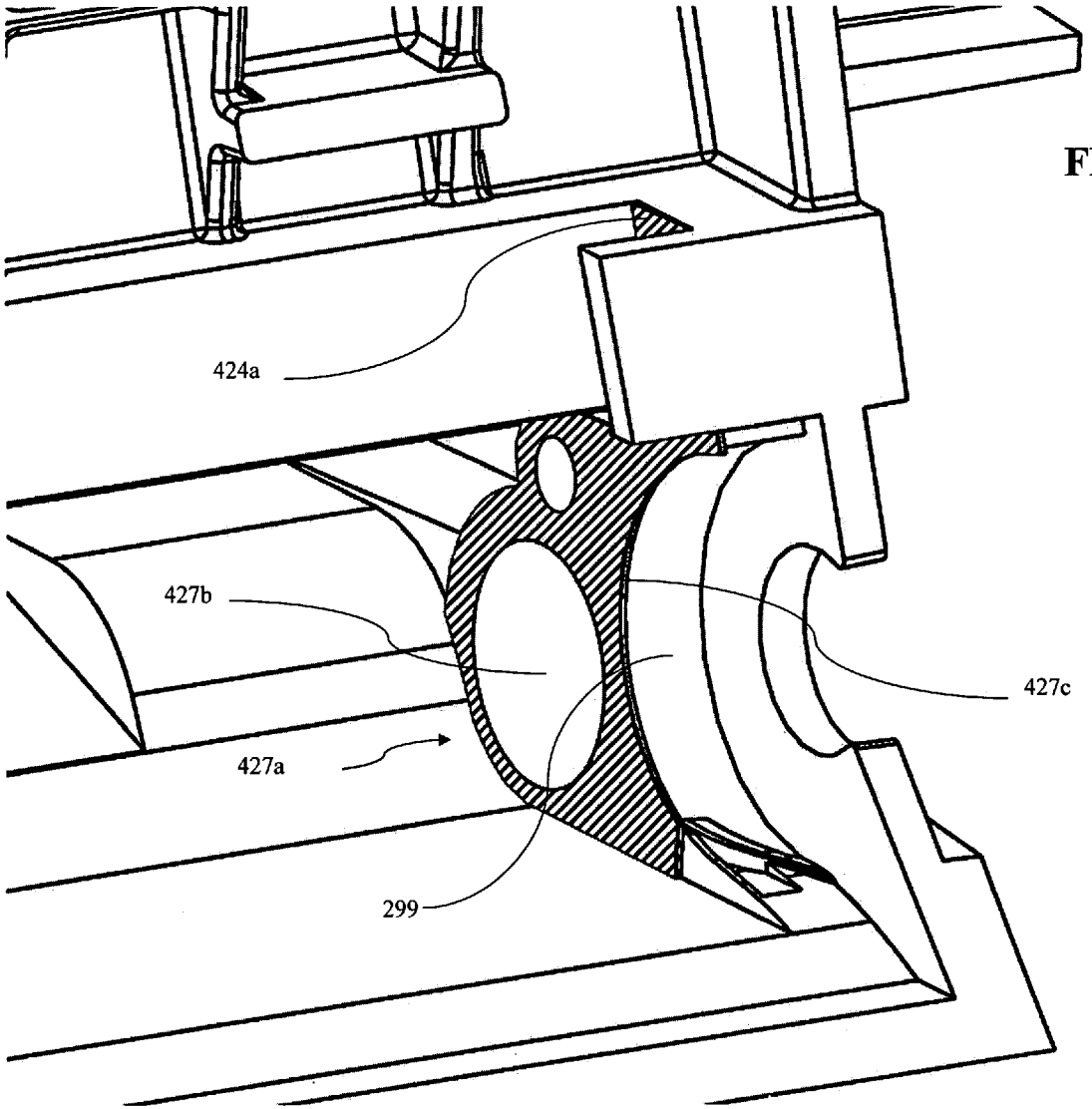

In an alternate embodiment, a thin rigid end seal 427*a* is constructed from metal or other non-yielding material. As shown in FIGS. 9A–9C, rigid end seal 427*a* is adapted for attachment to the inner surface 97*a* of toner cartridge 1. In one embodiment, aperture 427*b* is formed in rigid end seal 427*a* to accommodate the toner adder roller (not shown). The leading edge 427*c* of rigid end seal 427*a* is arcuate and is disposed adjacent arcuate recess 299 formed in the side walls of the toner cartridge. To form a tight seal with developer roller 296, leading edge 427*c* of rigid end seals 427*a* extend slightly past arcuate recess 299. In this manner the relatively pliable surface of developer roller 296 becomes slightly deformed as it engages and rotates across leading edge 427*c* of rigid end seals 427*a*. The interface of leading edge 427*c* of rigid end seals 427*a* and the deformable surface of developer roller 296 creates a fluid-tight seal through which toner cannot escape.

In a fashion similar to the soft end seals 427, discussed supra, rigid end seals 427*a* are equipped with an integral upper sealing surface 424*a*. Distal ends 428 of doctor bar 214 equipped with end gaskets 247, seal in flushing engagement with upper sealing surfaces 424*a* of rigid end seals 427*a*. The bottom surface of doctor bar 214 engages the relatively deformable surface of the developer roller 296 thereby forming a seal.

As with the embodiment discussed supra, doctor bar 214 is equipped with end gaskets 247 (FIG. 4) which engage the upper sealing surfaces 424*a* of the rigid end seals 427*a*. Since gaskets 247 are able to conform to the shape of meeting surfaces 424*a* as well as that of the developer roller 296, a watertight seal is formed which prevents the escape of toner from the cartridge.

The use of a rigid material allows a thinner end seal to be employed. The resulting thinner seal has less contact area with the developer roller and therefore generates less heat due to friction.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A toner cartridge adapted to fit within a toner cartridge-receiving cavity of a printer, comprising:

a ramp area depending from the body of said toner cartridge;

a developer roller having a cylindrical surface in overlying relation to said ramp area;

at least one arcuate recess adjacent to said ramp area to accommodate said developer roller therein;

a doctor bar;

a first elevated sealing surface integral with said arcuate recesses having a modulus of elasticity greater than that of said developer roller disposed to engage in conforming contact with said developer roller; and a second sealing surface disposed across said ramp area to mate with said cylindrical surface of said developer roller forming a fluid-tight barrier therebetween.

2. The toner cartridge of claim 1 further comprising gaskets disposed at the distal ends of said doctor bar whereby said gaskets sealingly engage the inner surface of the first elevated sealing surface.

3. The toner cartridge of claim 1 further comprising elevated regions at the distal ends of said ramp area disposed to elevate the distal ends of said second sealing surface.

4. The toner cartridge of claim 1 further comprising raised chamfered edges at the distal ends of said ramp area.

5. The toner cartridge of claim 1 further comprising a flattened area adjacent to said ramp area such that a pocket is formed when the toner cartridge is assembled.

6. The toner cartridge of claim 5 further comprising a non-hardenable sealant disposed within said pocket.

7. The toner cartridge of claim 4 further comprising chamfers on the distal edges of the second sealing surface to accommodate said chamfered edges of said ramp area.

8. A toner cartridge adapted to fit within a toner cartridge-receiving cavity of a printer, comprising:

a ramp area depending from the body of said toner cartridge;

a developer roller having a cylindrical surface in overlying relation to said ramp area;

an arcuate recess formed in at least one side wall of said toner cartridge adapted to receive said developer roller;

a doctor bar;

at least one lateral sealing interface disposed within, and conforming to, said arcuate recess having a raised ridge disposed along the inner circumference thereof in conforming engagement with said developer roller whereby said sealing interface engages the surface of said developer roller; and an upper sealing surface integral with said lateral sealing interface disposed to seal the lateral ends of said doctor bar against the inner surface of said raised ridge of the at least one lateral sealing surface.

9. The toner cartridge of claim 8 wherein said sealing interface further comprises raised chamfered edges adjacent the distal ends of said ramp area.

10. The toner cartridge of claim 8 wherein said sealing interface further comprises a flattened area adjacent to said ramp area such that a pocket is formed when the toner cartridge is assembled.

11. The toner cartridge of claim 10 further comprising a non-hardenable sealant disposed within said pocket.

12. The toner cartridge of claim 8 wherein said sealing interface further comprises elevated surfaces having a modulus of elasticity less than that of said developer roller disposed to engage in conforming contact with said developer roller.

13. A toner cartridge adapted to fit within a toner cartridge-receiving cavity of a printer, comprising:

a ramp area depending from the body of said toner cartridge;

a developer roller having a cylindrical surface in overlying relation to said ramp area;

an arcuate recess formed in at least one side wall of said toner cartridge adapted to receive said developer roller;

a doctor bar; and at least one lateral sealing interface having a leading edge conforming to, and extending to a point past, said arcuate recess whereby said sealing interface engages the cylindrical surface of said developer roller and the surface of said doctor bar.

14. The toner cartridge of claim 13 wherein said at least one lateral sealing surface has a modulus of elasticity greater than that of said developer roller.

15. The toner cartridge of claim 13 further comprising a sealing surface integral with said lateral sealing interface disposed to seal the lateral ends of said doctor bar.

* * * * *

UNITED STATES PATENT AND TRADEMARK OFFICE

CERTIFICATE OF CORRECTION

PATENT NO. : 7,177,565 B1
APPLICATION NO. : 11/120493
DATED : February 13, 2007
INVENTOR(S) : Steven Miller It is certified that error appears in the above-identified patent and that said Letters Patent is hereby corrected as shown below:

On patent cover page under Related U.S. Application Data, Line 2, after "continuation", insert -- in part --

In Specification, Column 1, Line 10, after "continuation", insert -- in part --

Signed and Sealed this

Twenty-fourth Day of August, 2010

David J. Kappos

David J. Kappos
*Director of the United States Patent and Trademark Office*